US006781496B2

(12) United States Patent
Kobayashi et al.

(10) Patent No.: US 6,781,496 B2
(45) Date of Patent: Aug. 24, 2004

(54) ELECTROMAGNETIC CONNECTING DEVICE FOR HIGH VOLTAGE AND LARGE CURRENT

(75) Inventors: Yasuo Kobayashi, Nerima-ku (JP); Takashi Majima, Yokohama (JP); Yuuji Sasaki, Ichikawa (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 127 days.

(21) Appl. No.: 10/076,439

(22) Filed: Feb. 19, 2002

(65) Prior Publication Data

US 2002/0171525 A1 Nov. 21, 2002

(30) Foreign Application Priority Data

May 18, 2001 (JP) ..... 2001/149661

(51) Int. Cl.[7] ..... H01F 27/04
(52) U.S. Cl. ..... 336/107; 336/115; 336/117
(58) Field of Search ..... 336/107, 115, 336/118, 120, 121, 123, 117

(56) References Cited

U.S. PATENT DOCUMENTS 4,321,572 A * 3/1982 Studer et al. ..... 336/83
4,754,180 A * 6/1988 Kiedrowski ..... 310/90.5
5,907,231 A * 5/1999 Watanabe et al. ..... 320/108
6,075,433 A * 6/2000 Ono et al. ..... 336/212
6,445,270 B1 * 9/2002 Ogasawara ..... 336/182
6,489,874 B2 * 12/2002 Katsura et al. ..... 336/130

* cited by examiner

*Primary Examiner*—Anh Mai
(74) *Attorney, Agent, or Firm*—Griffin & Szipl, PC

(57) ABSTRACT

A primary winding 12 connected to a high-voltage, a large-current power supply 1, a secondary winding 14 connected to an electromagnetic forming coil 2, and a magnetic core 16 for guiding the magnetic flux produced by the primary winding. The magnetic core 16 is composed of a primary core 16*a* on which the primary winding is wound and a secondary core 16*b* on which the secondary winding is wound. The primary core and the secondary core are magnetically connected in contact or in close proximity. The primary core and the secondary core are separated each other when the connector is disconnected. Thus, current pulses at a high voltage (for instance, 10 kV) with a large current (for example, 100 kA or more) and a narrow pulse width (e.g., 30 μsec or less) can be efficiently transmitted, and the connector easily attached and removed.

7 Claims, 5 Drawing Sheets

ELECTROMAGNETIC CONNECTING DEVICE FOR HIGH VOLTAGE AND LARGE CURRENT

BACKGROUND OF THE INVENTION

1. Technical Field of the Invention

The present invention relates to an electromagnetic connecting device for use with high voltages and large currents, which is detachable without using contacts.

2. Description of the Prior Art

Conventionally, a tandem press or transfer press is used to manufacture 3-dimensionally formed components with rather complicated shapes, such as automobile bodies or door panels. However, there are some pressed shapes that cannot be easily pressed using a conventional tandem or transfer press.

For instance, when a component, some part of which has a complicated shape, e.g. the handle portion of a door panel is pressed and formed, the edge cannot be formed precisely even with a pressing process, and the shape cannot be accurately finished. Therefore, when a high quality is particularly required, 2 or 3 processes are required, and as a result, a plurality of sets of upper and lower dies are needed, and a plurality of pressing processes must be provided, so that the production efficiency is low and the cost is high, which are practical problems.

In addition, there is a demand for aluminum material to be used to reduce the weight of a vehicle, however compared to steel sheets, aluminum has a large spring-back characteristic, therefore the shape cannot be finished precisely which is another problem in practice.

To solve these problems, the inventor of the present invention invented a continuous pressing equipment with which an aluminum material can be processed into a prescribed complicated shape using a small number of press machines, avoiding the spring-back phenomenon, and applied for a patent for it (Japanese patent application No. 65265/2000, not published at present).

This continuous pressing equipment is a tandem press or a transfer press with a plurality of press machines, using an electromagnetic forming apparatus provided within at least one press machine or between pressing machines.

According to the configuration of the present invention, because an electromagnetic forming apparatus is provided in a tandem press or transfer press or between presses, the material to be worked (panel) can be manufactured by electromagnetic forming (EMF) in conjunction with conventional mechanical pressing or hydraulic pressing. According to this EMF method, even a complicated shape can be formed because of the high-speed forming capability, and an aluminum material can be formed without any spring-back, which are advantages together with other preferred characteristics, so by using this method, even a shape that could not be formed by a conventional method can be formed.

The aforementioned electromagnetic forming apparatus is composed of an electromagnetic forming coil embedded in a die, a power supply unit, a switching circuit, etc. which must be connected electrically to this coil. However the power unit and switching circuit are so large that they must be installed at a fixed location outside the press machine, so a connector that connects the coil to the power supply unit that can be electrically detached is indispensable.

In an electromagnetic forming process, the coil must be excited with a large current (e.g. 100 KA or more) at a high-voltage (for instance, 10 kV), and a high-frequency (e.g., 30 kHz or more) half sine wave pulses.

However, in a conventional connector, the conductors (bus bars etc.) are held in contact by mechanical forces such as by applying a tightening torque, so a problem of such a connector is that excessive time and labor are spent in mounting and removing bolts etc.

Also with a conventional connector that is detachable without loosening bolts, known in the prior art, there is a large loss in the connector due to the large current and the contact resistance, so this type of connector has the problem that the above-mentioned high-voltage, large-current pulses cannot be transmitted efficiently.

The contactless power supply technology used conventionally in power supply systems of logistics etc. is restricted to a narrow range of applicable frequencies (about 20 kHz) and a low-voltage range, therefore the technology cannot be applied to the high-voltage, large-current pulses with a half sine wave shape at 30 kHz or more, that is, the object of the present invention.

Furthermore, the high-voltage, large-current pulse transformer that transmits electric energy through the electromagnetic coupling cannot be dismantled because the primary and secondary circuits are fixed.

SUMMARY OF THE INVENTION

The present invention is aimed at solving the aforementioned problems. That is, an object of the present invention is to provide a connector that can efficiently transmit high-voltage (for example, 10 kV), large-current (for instance, 100 kA or more) current pulses with a narrow pulse width (e.g., 30 $\mu$sec or less) and can be easily disconnected.

The present invention offers an electromagnetic connectors for high voltages and currents, comprised of a primary winding (12) connected to a high-voltage, large-current power supply (1), a secondary winding (14) connected to an electromagnetic forming coil (2), and a magnetic core (16) for passing the magnetic flux produced by the primary winding to the secondary winding, in which the magnetic core (16) is comprised of a primary core **(16*a*) on which the primary winding is installed and a secondary core (16*b*)** on which the secondary winding is installed; the primary core and the secondary core are magnetically connected together by putting them in contact or in close proximity, and separated each other when the connector is disconnected.

According to the configuration of the present invention, the primary core **(16*a*) and the secondary core (16*b*) are in contact or closely located, and are therefore connected magnetically; the magnetic flux produced by the primary winding using power supplied from the high-voltage, large-current power supply (1) passes through the secondary winding (14) in which the flux induces high-voltage, large-current pulses that are applied to the electromagnetic forming coil (2)** for electromagnetically forming the workpiece. In addition, because of the magnetic connection between the primary and secondary cores, high-voltage (for instance, 10 kV), large-current (for example, 100 kA or more) narrow pulse-width (e.g., 30 $\mu$sec or less) current pulses with a half sine wave shape can be transmitted efficiently.

Generally speaking, a conventional direct connection for very-high-voltage, large-current pulses to transmit electrical energy needs a large-scale configuration; however, the present invention uses an electromagnetic coupling instead of the conventional direct connection, and provides an easily detachable connector that can withstand a high voltage and has no contact resistance, that can be used when a power supply and a load must be frequently disconnected and re-connected. Thus, an apparatus using large-current pulses at a very-high voltage can be easily assembled into a production line where a time interval is a problem.

According to a preferred embodiment of the present invention, the above-mentioned magnetic core (16) is shaped as a closed rectangle, and the aforementioned primary core (16*a*) and secondary core (16*b*) are U-shaped, formed by cutting the above-mentioned rectangle into two parts.

Using this configuration, a detachable magnetic core (16) can be easily formed, and the leakage of magnetic flux, when the cores are connected, can be made small.

In addition, the two parts cut as above can be in close contact with each other or located close to each other when connected, and can be configured to keep a space between them when they are disconnected.

In this configuration, the large-current, high-voltage power supply can be easily connected or disconnected in a contactless manner by only placing the cut surfaces in contact (or close together) or separating them, respectively.

Furthermore, it is preferred that the primary winding (12) and the secondary winding (14) are wound on each core in such a way that the windings overlap each other concentrically when the cores are connected.

This configuration can pass the magnetic flux produced by the primary winding, through the secondary winding, with minimum leakage of magnetic flux when the cores are connected so improving the efficiency of the coupling.

The above-mentioned magnetic core (16) is preferably made of silicon steel sheet, ferrite material or amorphous material.

The core is not limited only to ordinary silicon sheet steel, and the use of a ferrite material or amorphous material can increase the coupling efficiency.

The aforementioned primary winding (12) and secondary winding (14) are molded in a plastic resin, separately.

The above-mentioned configuration can suppress the vibration of the windings due to large currents, while ensuring that the windings are capable of withstanding high voltage.

Other objects and advantages of the present invention are described below referring to the attached drawings.

DESCRIPTION OF PREFERRED EMBODIMENTS

Preferred embodiments of the present invention are described below referring to drawings. When a part is shown in several drawings it is identified with the same reference number, and no duplicate description is given.

Figure 1A:
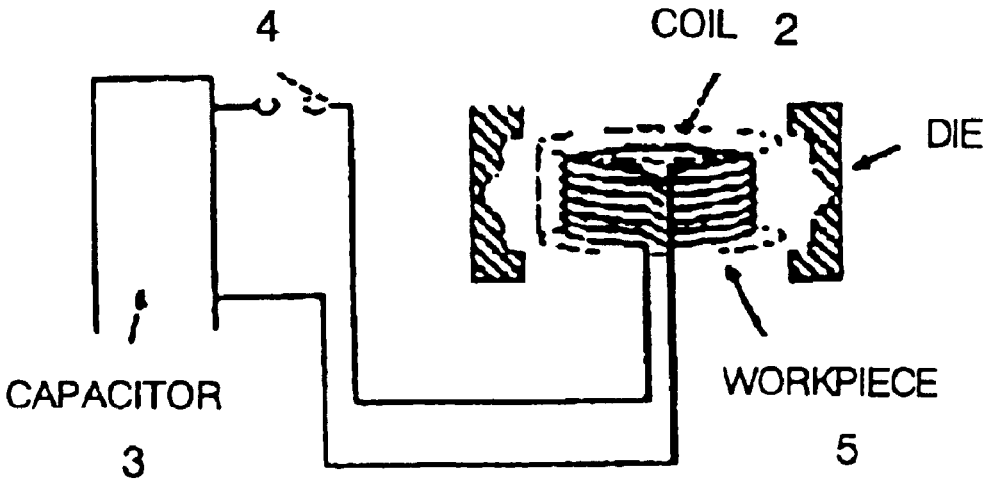
Fig.1A (PRIOR ART)
FIGS. 1A and 1B are conceptual views of the electromagnetic forming process.
Figure 1B:
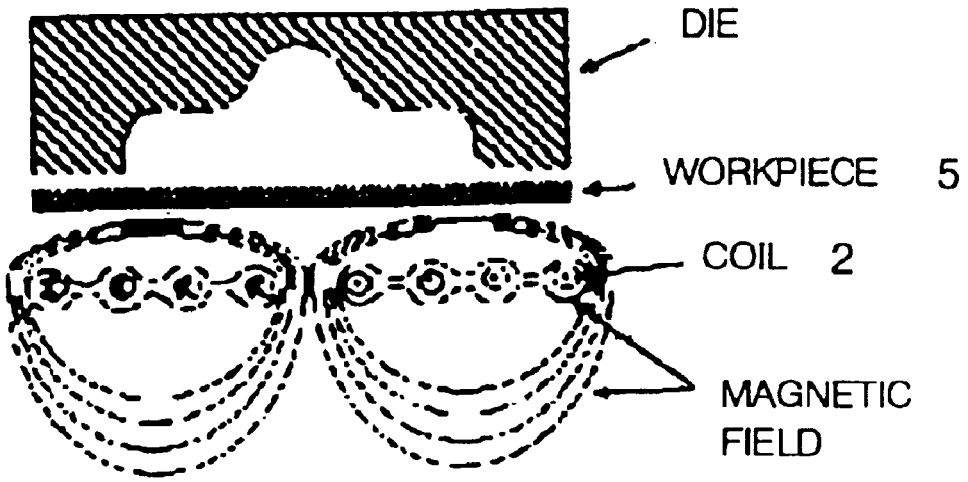
Fig.1B (PRIOR ART)

FIGS. 1A and 1B show the principles of electromagnetic forming, i.e. cylindrical forming and sheet forming, respectively. The electromagnetic forming system is a method of processing a metal workpiece using the energy of a magnetic field, so an intense magnetic field is required to produce a sufficient processing force. For this purpose, a large-capacitance, high-voltage capacitor 3 (capacitor bank) discharges current into a magnetic forming coil 2 to produce an instantaneous intense magnetic field which is used for forming.

More explicitly, the large-capacitance capacitor 3 stores energy at a high voltage of about 10 kV, for example, and by closing the discharge switch, the capacitor instantaneously outputs a large current (for instance, 150 kA, 30 $\mu$s) into the magnetic forming coil 2, so producing a strong magnetic field whereby a workpiece 5 to be formed is repeled by the magnetic field and formed along the surface of the die at a high speed.

Such an electromagnetic forming process as described above does not need a medium to transmit the processing force, such as water, unlike explosive or discharge forming, so the process can be carried out in air or in a vacuum, and the processing speed is so high that processing a workpiece is usually finished within one millisecond. In addition, this electromagnetic forming process provides various advantages such as that a workpiece with a complicated shape can be formed and that an aluminum workpiece can be formed into a prescribed shape without any spring-back effect, because of the high forming speed etc.

Figure 2:
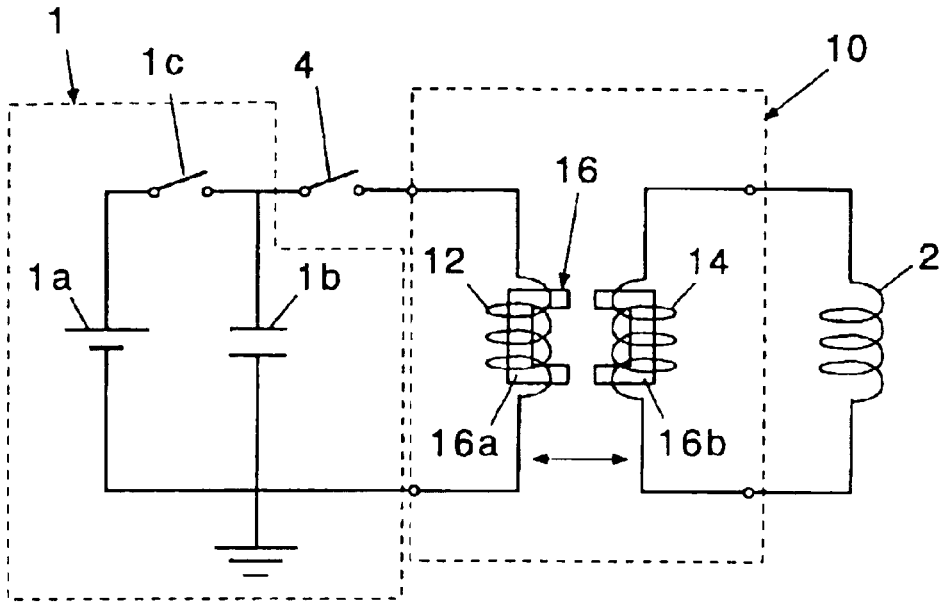
FIG. 2 shows the principles of the electromagnetic forming process using the electromagnetic connector for high voltages and large currents according to the present invention.

FIG. 2 shows the principles of an electromagnetic forming system using the electromagnetic connector for high voltages and large currents according to the present invention. In FIG. 2, the electromagnetic connector 10 for high voltages and large currents according to the present invention is comprised of a primary winding 12 connected to a high-voltage, large-current power supply 1, a secondary winding 14 connected to an electromagnetic forming coil 2, and a magnetic core 16 that passes the magnetic flux produced in the primary winding 12 through the secondary winding.

The high-voltage, large-current power supply 1 of this embodiment is comprised of a high-voltage DC power supply 1*a*, a capacitor 1*b* and a charging switch 1*c*. In this configuration, the DC power supply 1*a* produces a high voltage of, for example, about 10 kV and charges the large-capacitance capacitor 3 through the charging switch 1*c*, and by closing the discharge switch 4, large-current pulses of, for instance, 150 kA and 30 $\mu$s can be sent into the primary winding.

Figure 3:
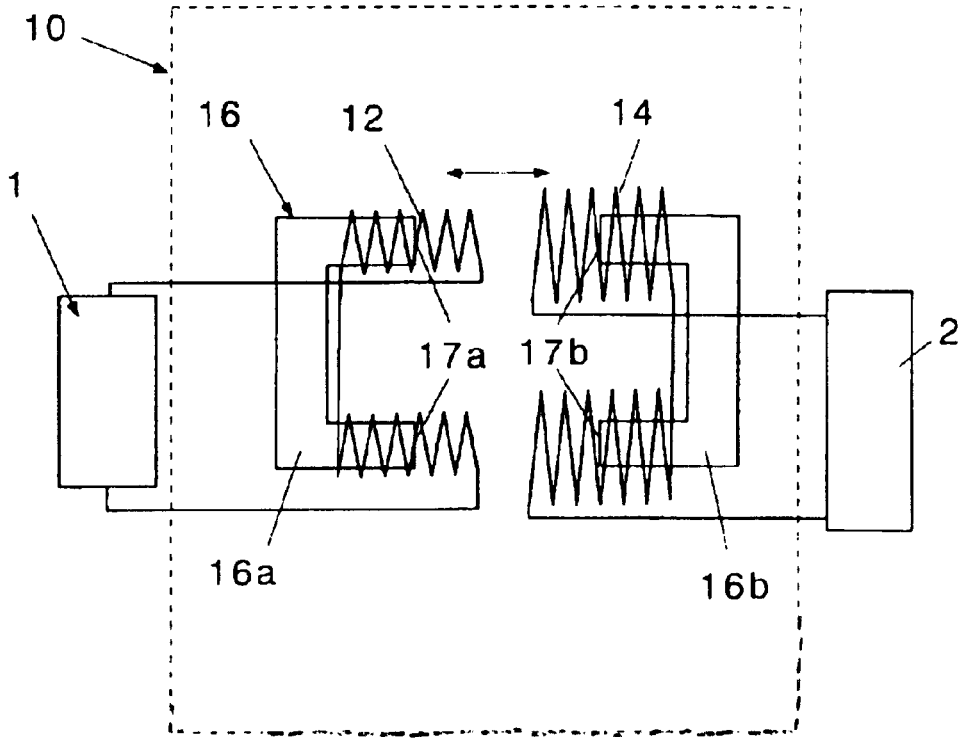
FIG. 3 is a diagram showing the principles of the electromagnetic connector for high voltages and large currents according to the present invention.

FIG. 3 is a view showing the principles of the electromagnetic connector for high voltages and large currents shown in FIG. 2 according to the present invention. In FIG. 3, a magnetic core 16 is comprised of a primary core 16*a* wound with the primary winding 12 and a secondary core 16*b* on which the secondary winding 14 is wound.

In this example, the magnetic core 16 has a closed rectangular shape. The primary and secondary cores 16*a*, 16*b* have U shapes produced from the rectangular core 16 by cutting along the surfaces 17*a*, 17*b*. The shape of the cross section of the core in this example is square, but the present invention is not limited only to this example, instead, any other cross sectional shape such as an oblong, circle or ellipse can be used.

The cut surfaces 17*a*, 17*b* of the primary and secondary cores 16*a*, 16*b* are located in close contact or slightly separated so that the magnetic flux leakage is small when the connector is connected. When the connector is disconnected, the cut surfaces 17*a*, 17*b* are separated by a gap such that the magnetic flux produced in the primary core 16*a* does not enter the secondary core 16*b*.

As shown typically in FIG. 3, primary and secondary windings 12, 14 are wound on each core in such a manner that when the connector is connected, the primary winding 12 and the secondary winding 14 are arranged concentrically, so that the magnetic flux produced in the primary winding passes completely through the secondary winding, and the magnetic flux leakage is reduced when the connector is connected and the coupling efficiency is improved.

Figure 4:
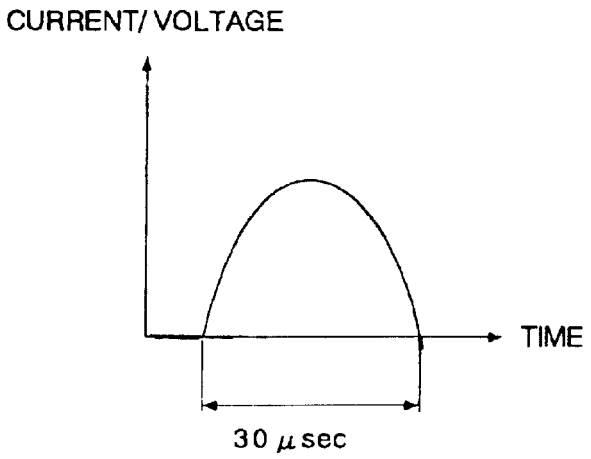
FIG. 4 shows a high voltage large current pulse transmitted through the electromagnetic connector for high voltages, and large currents according to the present invention.

FIG. 4 is a graph showing the characteristic of a high-voltage large current pulse transmitted by the electromagnetic connector for high voltages and large currents according to the present invention. In this embodiment, the high-voltage, large current pulse transmitted through the electromagnetic connector 10 for high voltages and large currents according to the present invention has a half sine wave shape with a pulse width of about 30 μsec, and the peak voltage is about 10 kV and the peak current is about 150 kA.

Using the above-mentioned configuration of the present invention, the winding ratio of the primary winding 12 to the secondary winding 14 is made 1:1, thereby large-current pulses of for instance 150 kA and 30 μs, passing through the primary winding 12 can be transmitted unchanged into the secondary winding 14 with a high power transmission efficiency of about 90% or more.

Figure 5:
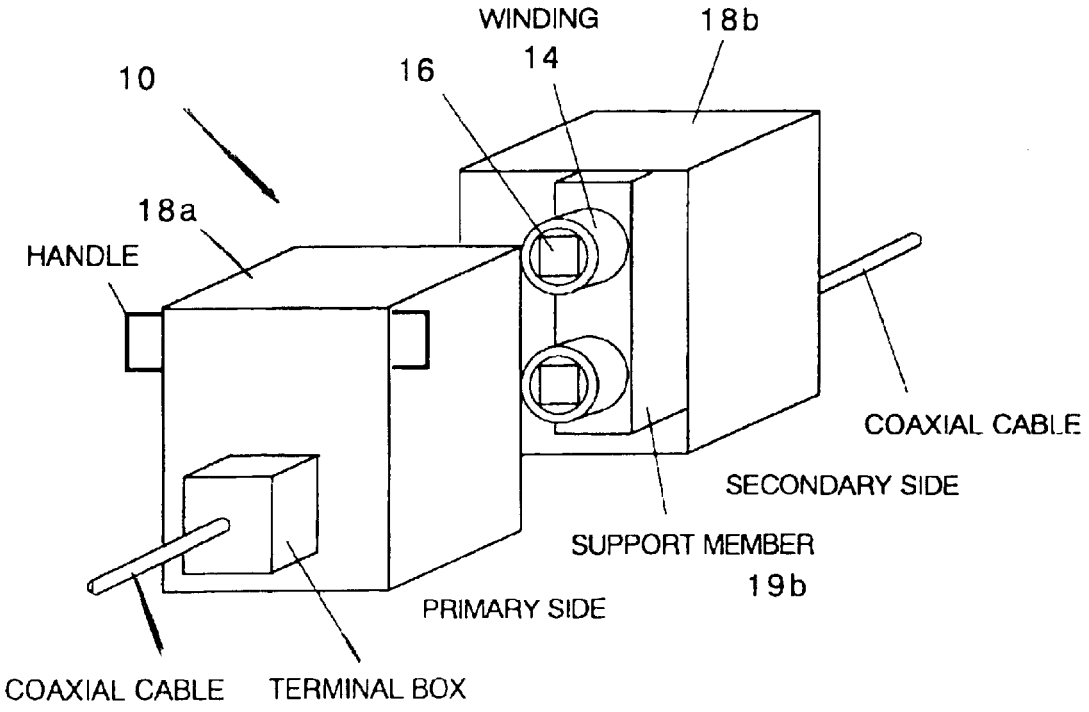
FIG. 5 is an isometric view of the electromagnetic connector for high voltages and large currents according to the present invention.
Figure 6A:
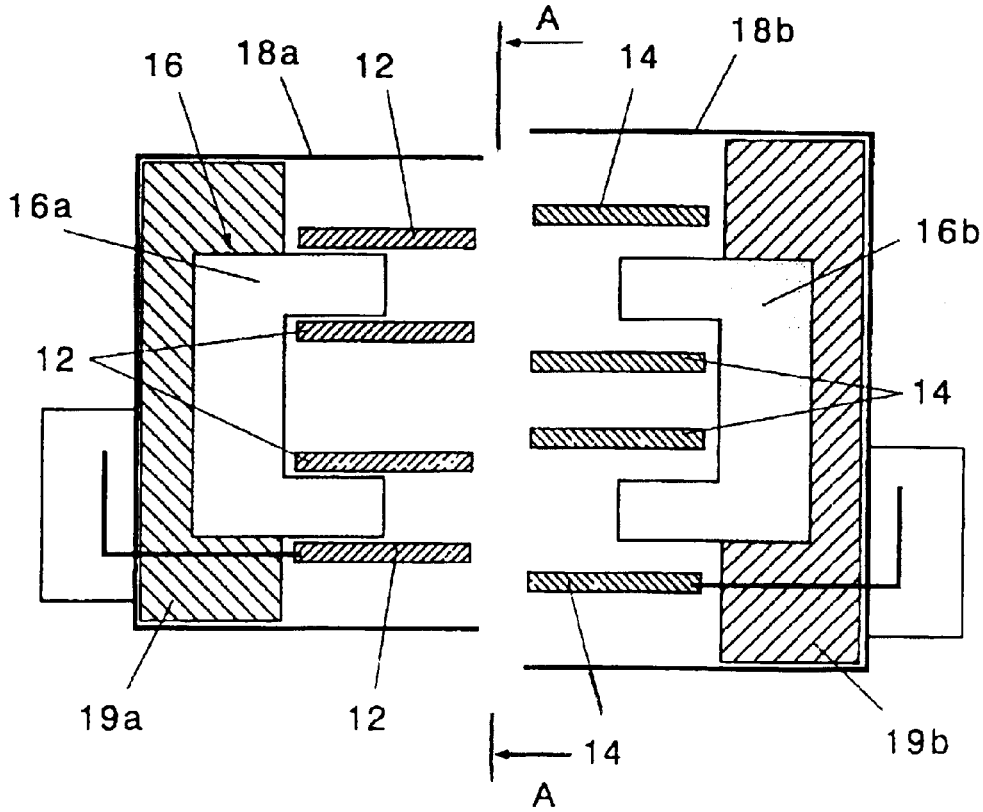
FIGS. 6A and 6B show the sectional arrangement of the electromagnetic connector for high voltages and large currents according to the present invention.
Figure 6B:
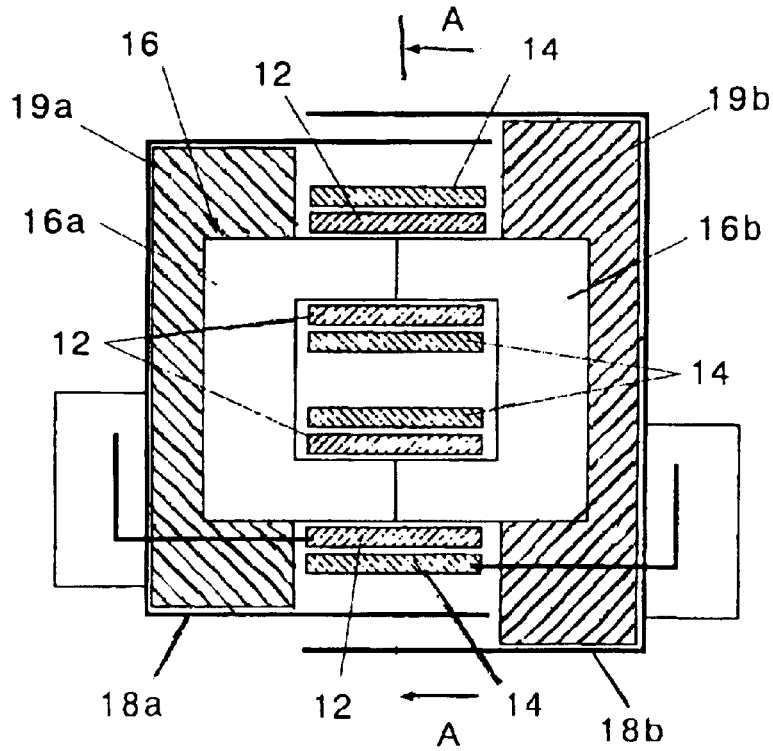
Figure 7A:
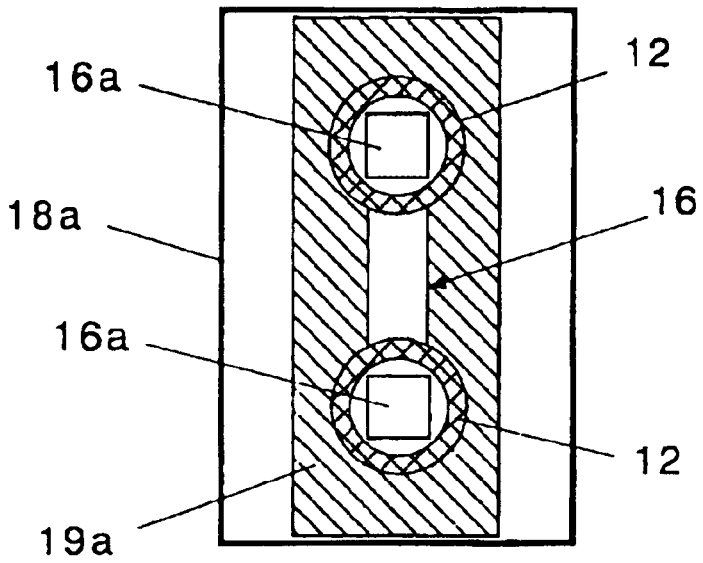
FIGS. 7A and 7B show sections along the line A—A in FIGS. 6A and 6B, respectively.
Figure 7B:
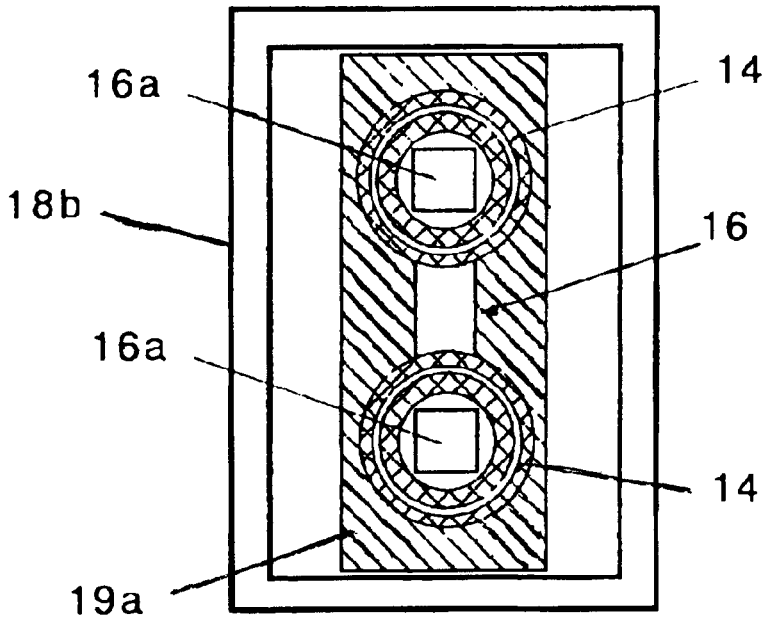

FIGS. 5 to 7 are drawings of preferred practical embodiments of the electromagnetic connector 10 for a high voltages and large currents according to the present invention. FIG. 5 is an isometric view, FIGS. 6A and 6B are sectional drawings showing the construction, and FIGS. 7A and 7B are sections along the lines A—A in FIGS. 6A and 6B, respectively. FIGS. 6A and 7A show the state of the connector when it is disconnected, while FIGS. 6B and 7B show the connected state.

In FIG. 5, this electromagnetic connector 10 for high voltages and large currents is shielded to reduce electromagnetic noise by housing the primary and secondary portions in separate casings 18*a*, 18*b*. Casings 18*a*, 18*b* are connected to earth through grounding lines not illustrated. In FIGS. 6A and 6B, the coupling portions of casings 18*a*, 18*b* are open, and when they are connected mechanically and magnetically, the open portions overlap each other to establish a fully enclosed condition.

In FIG. 5, coaxial cables are used as the input and output cables to shield against electromagnetic noise. To facilitate inserting and removing the primary portion, a handle is provided on the primary casing 18*a*. In addition, sensors such as proximity switches are also provided to indicate by means of electrical signals that the primary side has been connected completely to the secondary side.

As shown in FIGS. 6A and 6B or 7A and 7B, the core 16 of this embodiment is disposed vertically, and the primary and secondary sides are attached and separated in a horizontal direction. The magnetic core 16 is composed of silicon steel sheets, ferrite material or amorphous material.

The primary winding 12 and the secondary winding 14 are molded into the supporting bodies 19*a*, 19*b* (made of, for instance, a plastic resin).

The primary and secondary windings are disposed so that when the coupling is connected, the primary winding 12 overlaps the secondary winding 14 concentrically. In addition, a clearance of about 1 to 2 mm is provided between the core and the winding, between the primary casing and the secondary casing and between the primary winding and the secondary winding, so that the primary side and the secondary side can be connected together smoothly.

According to the above-mentioned configuration of the present invention, the primary core is connected magnetically to the secondary core 16*b* by locating them in contact or close together, the flux produced in the primary winding by the high-voltage, large-current power supply 1, passes through the secondary winding and high-voltage, large-current pulses are induced by this magnetic flux in the secondary winding 14 and are applied to the electromagnetic forming coil 2, whereby the workpiece can be formed electromagnetically. Since the coils are connected magnetically, current pulses with a half sine wave shape can be efficiently transmitted at a high voltage (for instance, 10 kV), with a large magnitude (for example, 100 kA or more) and a narrow pulse width (e.g., 30 μsec or less).

If a conventional direct connection is used to transmit electric energy by means of large-current pulses at a very-high voltage, the connecting system generally becomes large in size; however by using an electromagnetic connection, the connector can be made easily detachable, capable of withstanding a high voltage and free from contact resistance. Consequently, the connector can be used between a power supply and a load that must be frequently connected and disconnected. Therefore, an apparatus using large-current pulses at a very-high voltage can be easily incorporated into a production line where timing or cycle time is critical, unlike conventional connections.

In conclusion, the electromagnetic connector for a high voltages and large currents according to the present invention provides various advantages such as that current pulses can be efficiently transmitted at a high voltage, with a large current and a high frequency and that the connector can be easily connected and disconnected.

Of course, the present invention is not limited only to the aforementioned embodiments, but can be modified in various ways as long as the scope of the claims of the present invention is not exceeded. For example, the electromagnetic connector for high voltages and large currents according to the present invention can be applied also to purposes other than electromagnetic forming.

What is claimed is:

1. An electromagnetic connector for high voltages and large currents, comprising a primary winding connected to a high-voltage, large-current power supply, a secondary winding connected to an electromagnetic forming coil, and a magnetic core for guiding the magnetic flux produced by the primary winding, into the secondary winding, wherein the magnetic core comprises a primary core with a primary winding and a secondary core with a secondary winding, the primary core and the secondary core are magnetically connected together by putting them in contact or in close proximity, and separated from each other when when the connector is disconnected.

2. The electromagnetic connector for high voltages and large currents, specified in claim 1, wherein the magnetic core is a closed rectangle in shape, and the primary core and the secondary core comprise U-shaped structures produced from the rectangle by cutting the rectangle into two parts.

3. The electromagnetic connector for high voltages and large currents specified in claim 2, wherein the cut surfaces of both the U-shaped structures are in close contact with each other or located close to each other when connected, and can be configured to keep a space between them when they are disconnected.

4. The electromagnetic connector for high voltages and large currents, specified in claim 1, wherein the primary winding and the secondary winding are wound on each core in such a manner that both windings overlap each other concentrically, when the connector is connected.

5. The electromagnetic connector for high voltages and large currents, specified in claim 1, wherein the magnetic core comprises silicon steel sheets, a ferrite material or an amorphous material.

6. The electromagnetic connector for high voltages and large currents, specified in claim 1, wherein the primary winding and the secondary winding are molded separately in a plastic resin.

7. The electromagnetic connector for high voltages and large currents, specified in claim 4, wherein said primary and secondary cores have U shapes.

* * * * *